US005656191A

United States Patent [19]

Lee

[11] Patent Number: 5,656,191

[45] Date of Patent: Aug. 12, 1997

[54] METHOD FOR CONTROLLING COOKING BY USING A VAPOR SENSOR IN A MICROWAVE OVEN

[75] Inventor: Charng-Gwon Lee, Bupyeong-Ku, Rep. of Korea

[73] Assignee: Daewoo Electronics Co., Ltd., Seoul, Rep. of Korea

[21] Appl. No.: 578,183

[22] Filed: Dec. 29, 1995

[30] Foreign Application Priority Data

Sep. 18, 1995 [KR] Rep. of Korea ..... 95-30527

[51] Int. Cl.[6] ..... H05B 6/68

[52] U.S. Cl. ..... 219/707; 219/705; 219/710; 99/325

[58] Field of Search ..... 219/707, 710, 219/705, 757; 99/DIG. 14, 325

[56] References Cited

U.S. PATENT DOCUMENTS

| | | | |
|---|---|---|---|
| 4,097,707 | 6/1978 | Kobayashi et al. | 219/707 |
| 4,316,068 | 2/1982 | Tanabe | 219/705 |
| 4,376,131 | 3/1983 | Mori et al. | 219/705 |
| 4,814,570 | 3/1989 | Takizaki | 219/707 |
| 5,155,339 | 10/1992 | An | 219/707 |
| 5,464,967 | 11/1996 | Gong | 219/707 |

*Primary Examiner*—Philip H. Leung

*Attorney, Agent, or Firm*—Beveridge, DeGrandi, Weilacher & Young LLP

[57] ABSTRACT

A method for controlling cooking by using a vapor sensor in a microwave oven measures and records a magnitude of a detecting signal from the vapor sensor in response to water vapor generated from food subjected to heating. When the temperature of food is judged to exceed a predetermined temperature on the basis of the measured magnitude of the detecting signal, a control section compares the average magnitudes of the detecting signals from the vapor sensor with reference magnitudes to judge whether the temperature of food subjected to heating corresponds to a reasonable temperature. If the temperature of food is lower than the reasonable temperature, the food is additionally heated for a preset time. Thus, the outputs of the vapor sensor varied according to the sizes of containers filled with food are selectively controlled to prevent the malfunction of the vapor sensor caused by the different sizes of containers.

15 Claims, 3 Drawing Sheets

METHOD FOR CONTROLLING COOKING BY USING A VAPOR SENSOR IN A MICROWAVE OVEN

BACKGROUND OF THE INVENTION

1. Field of the Invention

The present invention relates to a method for controlling cooking by using a vapor sensor in a microwave oven, and more particularly to a method for controlling cooking by using a vapor sensor in a microwave oven, in which a malfunction of the vapor sensor caused by different sizes of containers filled with food subjected to heating is prevented while food is cooked by means of me microwave oven equipped with the vapor sensor therein.

2. Description of the Prior Art

FIG. 1 is a schematic construction view for showing an internal structure of general microwave oven equipped with a vapor sensor therein. As shown in FIG. 1, in microwave oven 10 for controlling an automatic cooking operation by using the vapor sensor, while a high voltage transformer 100 applies a high voltage electricity to a magnetron 200, microwave is generated from the magnetron 200, and the microwave heats food within a cooking chamber formed by a cavity 300.

Meanwhile, water vapor is generated from the heated food, and then discharged along the air flow which effuse from first blow holes 311 formed in the upper portion of a first sidewall 310 of cavity 300 by a blow operation of a fan motor 400 and sequentially passes through first exhaust holes 321 formed in the lower portion of a second sidewall 320 disposed in opposition to first sidewall 310 and first discharge holes 500. Also, the water vapor is discharged along the air flow which sequentially passes through second exhaust holes 331 formed in the central portion of a ceiling portion 130 of cavity 300, a wind path 500 and second discharge holes 700. Then, the energy of the water vapor discharged along wind path 500 is sensed by vapor sensor 800 which also has the characteristics of a piezo-electric device attached to inlets of second discharge holes 700, so that a heating time is properly adjusted to control the automatic cooking operation.

When vapor sensor 800 sucks in or discharges heat, vapor sensor 800 outputs a detecting signal in the form of an alternating current signal. The magnitudes of the detecting signals at 0° C. and 100° C. are respectively very small positive values which are similar to each other. As another example, if the temperature increases from 0° C. to 100° C., then the value of the detecting signal increases in a positive (+) direction. On the contrary, if the temperature decreases from 100° C. to 90° C., then the value of the detecting signal decreases in a negative (−) direction.

In an automatic cooking mode in which vapor sensor 800 is used, the output of magnetron 200 is similarly applied regardless of the amount of food subjected to heating, the size, or the shape of the container filled with food subjected to heating. Therefore, if the amount of food subjected to heating increases with respect to the same container, the time interval until cooking completion lengthens but the output of vapor sensor 800 becomes similar. However, if the size of the container increases with respect to the same amount of food subjected to heating, the time interval until cooking completion shortens and the output of vapor sensor 800 decreases.

One example of an automatic thawing device of a microwave oven and control method thereof is disclosed in U.S. Pat. No. 5,436,433 issued to Kim et al. Here, a turntable is rotatably placed in a cooking chamber. A gas sensor is placed about an exhaust port of the oven and senses the amount of gas or vapor exhausted from the cooking chamber through the exhaust port during a thawing operation, and outputs a gas amount signal to a microprocessor. The microprocessor calculates the thawing time by an operation of the output signal of the gas sensor and outputs a thawing control signal for driving the microwave oven. An output drive means controls output level of electromagnetic wave of high frequency of a magnetron in accordance with the thawing control signal of the microprocessor. The magnetron generates the electromagnetic wave of high frequency in accordance with the output signal of the drive means for the thawing time. A power source supplies an electric power to the thawing device in accordance with the thawing control signal of the microprocessor.

U.S. Pat. No. 5,445,009 issued to Yang et al. is given as an example of an apparatus and method for detecting humidity in a microwave oven. The apparatus and method for removing the influence of microwave noise without any shielding parts increases the reliability of detected humidity information. According to this patent, the cumulative difference of humidity values sensed by a humidity sensor is calculated for each half period of a commercial alternating current frequence, oscillating and non-oscillating terms of a magnetron are determined by comparing the calculated cumulative differences with each other, and the humidity-sensed values obtained during the determined non-oscillating terms of the magnetron are used as humidity information for automatic cooking control. In order to even further remove the influence of the microwave noise, the humidity sensor may include capacitors for bypassing the microwave noise introduced into the sensor.

As on example of a method for automatically controlling the cooking of food with a low moisture content, U.S. Pat. No. 5,395,633 issued to Lee et al. discloses an automatic cooking control method capable of cooking food with a low moisture content at an optimum by utilizing a variation in an output voltage of a humidity sensor. When a key signal corresponding to food with the low moisture content is received, an initialization is performed. Then, the maximum voltage indicative of the maximum humidity is determined by reading the continuously increasing output voltage from the humidity sensor 10 times for 10 seconds. After the determination of the maximum voltage, a determination is made whether the output voltage has reached a sensing voltage corresponding to a voltage obtained by deducing, from the maximum voltage, a mixture voltage varied depending on the kind of food. The cooking operation is complexed when the output voltage from the humidity sensor has reached the sensing voltage.

Hence, when the same amount of food is served in the containers having different sizes and then heated in the conventional microwave oven which controls the automatic cooking operation by using the vapor sensor, a different cooking result is produced in accordance with the size of the container. However, as a user anticipates the same cooking result with respect to the same food subjected to heating regardless of the size of the container, the user misunderstands the performance of the microwave oven, thereby reducing the user's reliability concerning the performance of the microwave oven and the consumer's intention with which the microwave oven is purchased.

SUMMARY OF THE INVENTION

Accordingly, it is an object of the present invention to provide a method for controlling cooking by using a vapor sensor, in which selectively controlled is the output of the vapor sensor varied in accordance with a size of a container to prevent a malfunction caused by the different sizes of the container filled with food subjected to heating while food is cooked by means of the microwave oven equipped with the vapor sensor therein.

In order to achieve the above object of the present invention, the present invention provides a method for controlling cooking by using a vapor sensor in a microwave oven which comprises the steps of:

measuring a magnitude of a detecting signal produced from the vapor sensor and varied in accordance with the sizes of containers filled with food subjected to heating in response to an energy of water vapor of the food which is generated from the food while food is cooked by using the microwave oven equipped with the vapor sensor therein;

determining whether or not a temperature of the food is a second predetermined temperature by comparing values of variables of a counter with reference phases and by comparing average magnitudes with magnitudes of the reference detecting signals and when it is judged that the temperature of the food exceeds a first predetermined temperature based on the measured magnitude of the detecting signal of the vapor sensor; and additionally heating the food for a preset time until the temperature of the food is raised to the second predetermined temperature when it is determined that the temperature is lower than the second predetermined temperature.

Preferably, the measuring step comprises the substeps of: operating microwave generating means by load driving means, and operating blowing means by control means;

initializing both a variable of a counter and a sum variable to zeros in order to measure the magnitude of the detecting signal supplied from the vapor sensor; and measuring the magnitude of the detecting signal supplied from the vapor sensor in response to the suction or discharge of heat of of the water vapor generated from the food in accordance with the driving of the blowing means.

Preferably, the determining step comprises the substeps of: judging whether the measured magnitude of the detecting signal from the vapor sensor is greater than or equal to the magnitude of a reference detecting signal;

returning to the step of initializing both the variable of the counter and the sum variable to zeros and repeating the succeeding steps when it is judged that the measured magnitude of the detecting signal supplied from the vapor sensor is smaller than the magnitude of the reference detecting signal;

calculating values of both the variable of the counter and the sum variable, and calculating, based on the calculated values of both the variable of the counter and the sum variable, a value or an average magnitude which is an average value of the magnitudes of the detecting signal when it is judged that the measured magnitude of the detecting signal supplied from the vapor sensor is greater than or equal to the magnitude of the reference detecting signal;

judging whether the value of the variable of the counter representing a phase of the detecting signal is greater than or equal to a first phase;

judging whether the value of the average magnitude of the detecting signals greater than or equal to a first reference magnitude corresponding to a first reference temperature of the food subjected to heating when it is judged that the value of the variable of the counter is greater than or equal to the first phase;

judging whether the value of the variable of the counter is greater than or equal to a second phase when it is judged that the value of the variable of the counter is smaller than the first phase;

judging whether the value of the average magnitude is greater than or equal to the second reference magnitude corresponding to a second reference temperature of the food subjected to heating when it is judged that the value of the variable of the counter is greater than or equal to the second phase;

judging whether the value of the variable of the counter is greater than or equal to a third phase when it is judged that the value of the variable of the counter is smaller than the second phase;

judging whether the value of the average magnitude is greater than or equal to a third reference magnitude corresponding to the third reasonable temperature of the food subjected to heating when it is judged that the value of the variable of the counter is greater than or equal to the third phase;

returning to the step of measuring the magnitude of the detecting signal supplied from the vapor sensor and repeating the succeeding steps when it is judged that the value of the variable of the counter is smaller than the third phase; and stopping an automatic cooking operation without executing an additional heating operation when the value of the average magnitude of the detecting signals is greater than or equal to the first, second, or third reference magnitudes to judge that the size of the container is appropriate.

Further, preferably, the variable of the counter is the phase of the detecting signal supplied from the vapor sensor, and the variable of the counter is designated by a relation that "C–C+1", where the variable of the counter is denoted by "C". Further, preferably, the sum variable is designated by a relation that "S–S+M", where the sum variable and the magnitude of the detecting signal are respectively denoted by "S" and "M". Further, preferably, the average magnitude is designated by a relation that "A–S / C", where the average magnitude is denoted by "A", and the sum variable and the phase are respectively denoted "S" and "C". Further, preferably, the first, second and third phases have a relation that "$0<C_3<C_2<C_1$", where the first, second and third phases are respectively denoted by "$C_1$", "$C_2$" and "$C_3$". Further, preferably, the first, second and third references magnitudes are relevant magnitude coordinate values when phase coordinate values are respectively the first, second and third phases.

Further, preferably, the additionally heating step comprises the substeps of:

executing the additional heating operation for the additional time preset in order to raise the temperature of the food subjected to heating to the second predetermined temperature when the average magnitude is smaller than the first, second, or third reference magnitudes to judge that the average temperature of the molecules of the water vapor generated from the food subjected to heating is lower than the desired reasonable temperature;

judging whether the heating time is greater than or equal to the additional time;

returning to the step of executing the additional heating operation and repeating the additional heating operation when the heating time is smaller than the additional time; and stopping the additional heating operation when the heating time is greater than or equal to the additional time.

In the method for controlling the cooking by using a vapor sensor in a microwave oven according to the present invention, while the food is cooked by means of the microwave oven equipped with the vapor sensor therein, the output of the vapor sensor varied in accordance with the sizes of the containers filled with the food subjected to heating is selectively controlled, and the malfunction of the vapor sensor caused by the different sizes of the containers can be prevented. Therefore, the performance and life span of the microwave oven are significantly enhanced to remarkably heighten the the user's reliability concerning the performance of the microwave oven and the consumer's intention with which the microwave oven is purchased.

BRIEF DESCRIPTION OF THE DRAWINGS

The above objects and other advantages of the present invention will become more apparent by describing in detail a preferred embodiment thereof with reference to the attached drawings, in which.

DESCRIPTION OF THE PREFERRED EMBODIMENT

A description will be given below in detail to the configuration and related operation of a method for controlling cooking by using a vapor sensor in a microwave oven according to an embodiment of the present invention with reference to the accompanying drawings.

Figure 1:
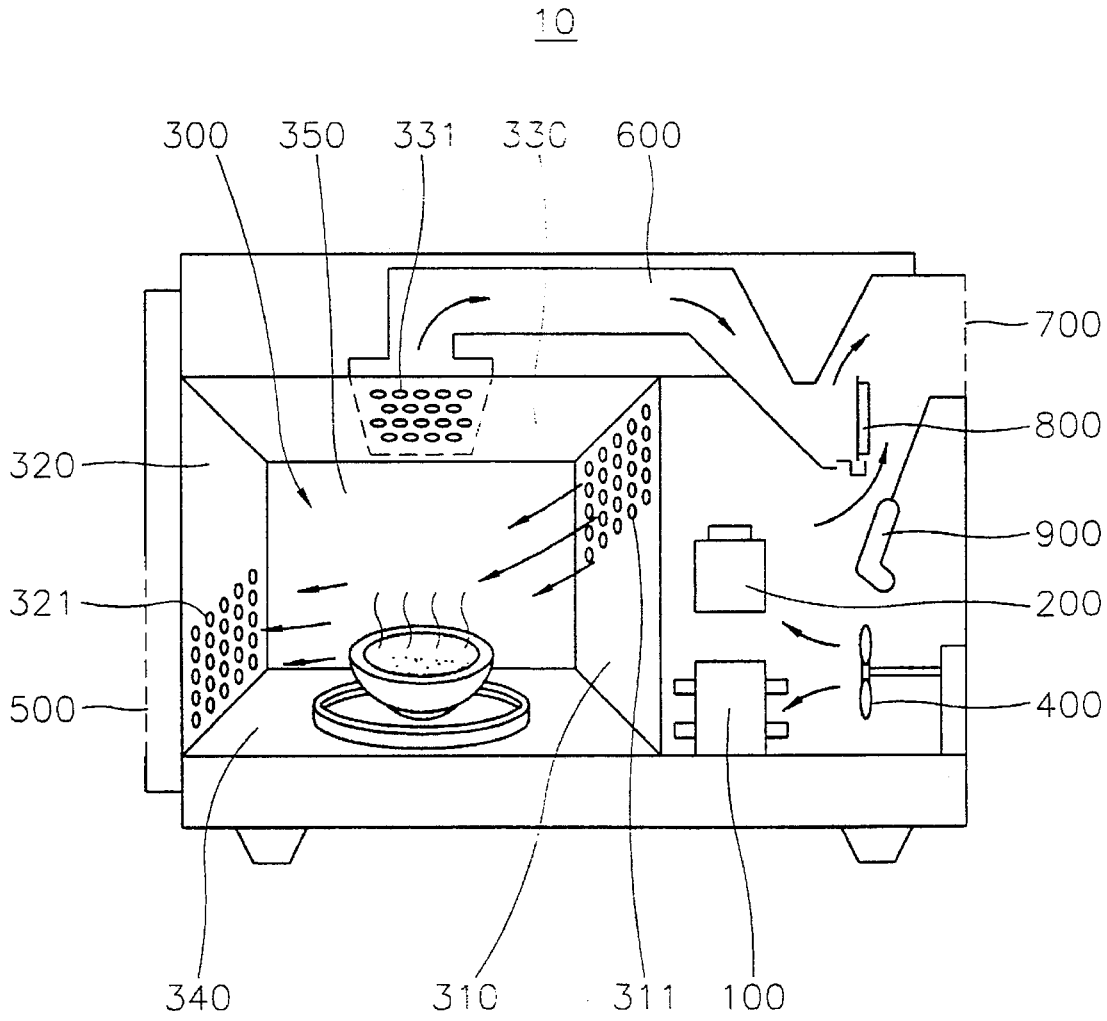
FIG. 1 (PRIOR ART)
FIG. 1 is a schematic construction view for showing an internal structure of a general microwave oven equipped with a vapor sensor therein.

FIG. 1 is a schematic construction view for showing an internal structure of a general microwave oven equipped with a vapor sensor therein. As shown in FIG. 1, microwave oven 10 includes a cavity 300 which is disposed at the left half portion thereof to form a cooking chamber, and is equipped with a variety of electric devices which perform an automatic cooking operation of microwave oven 10 at the right half portion therein. Cavity 300 includes a first sidewall 310 arranged on the right side, a second sidewall 320 arranged on the left side, a ceiling portion 330 arranged in the upper portion, a floor portion 340 arranged in the lower portion thereof, and a rear surface portion 350 arranged rearward. First sidewall 310 has first blow holes 311 in the upper portion thereof. Second sidewall 320 has first exhaust holes 320 in the lower portion thereof. Ceiling portion 330 has second exhaust holes 331 in the central portion thereof. A main body of microwave oven 10 includes first discharge holes 500 in the lower portion of the left outer wall. First discharge holes 500 are interconnected with first exhaust holes 321. The main body of microwave oven 10 has a wind path 600 arranged over cavity 300, and an inlet of wind path 600 is interconnected with second exhaust holes 331 included in ceiling portion 330 of cavity 300. The main body of microwave oven 10 further has second discharge holes 700 in the upper portion of the right outer wall thereof. Second discharge holes 700 are interconnected with an outlet of wind path 600.

Vapor sensor 800 is internally installed in the right half portion of the main body included in microwave oven 10, and detects water vapor generated from food subjected to heating while the automatic cooking operation is performed. Also, the right half portion included in the main body of microwave oven 10 is internally equipped with a high voltage transformer 100 which applies a high voltage electricity to a magnetron 200 which generates a microwave, a fan motor 400 which promotes a blowing operation, and an orifice 900. A door (not shown) is installed in front surface portion of cavity 300 and isolates cavity 300 from the other space during the automatic cooking operation.

Figure 2:
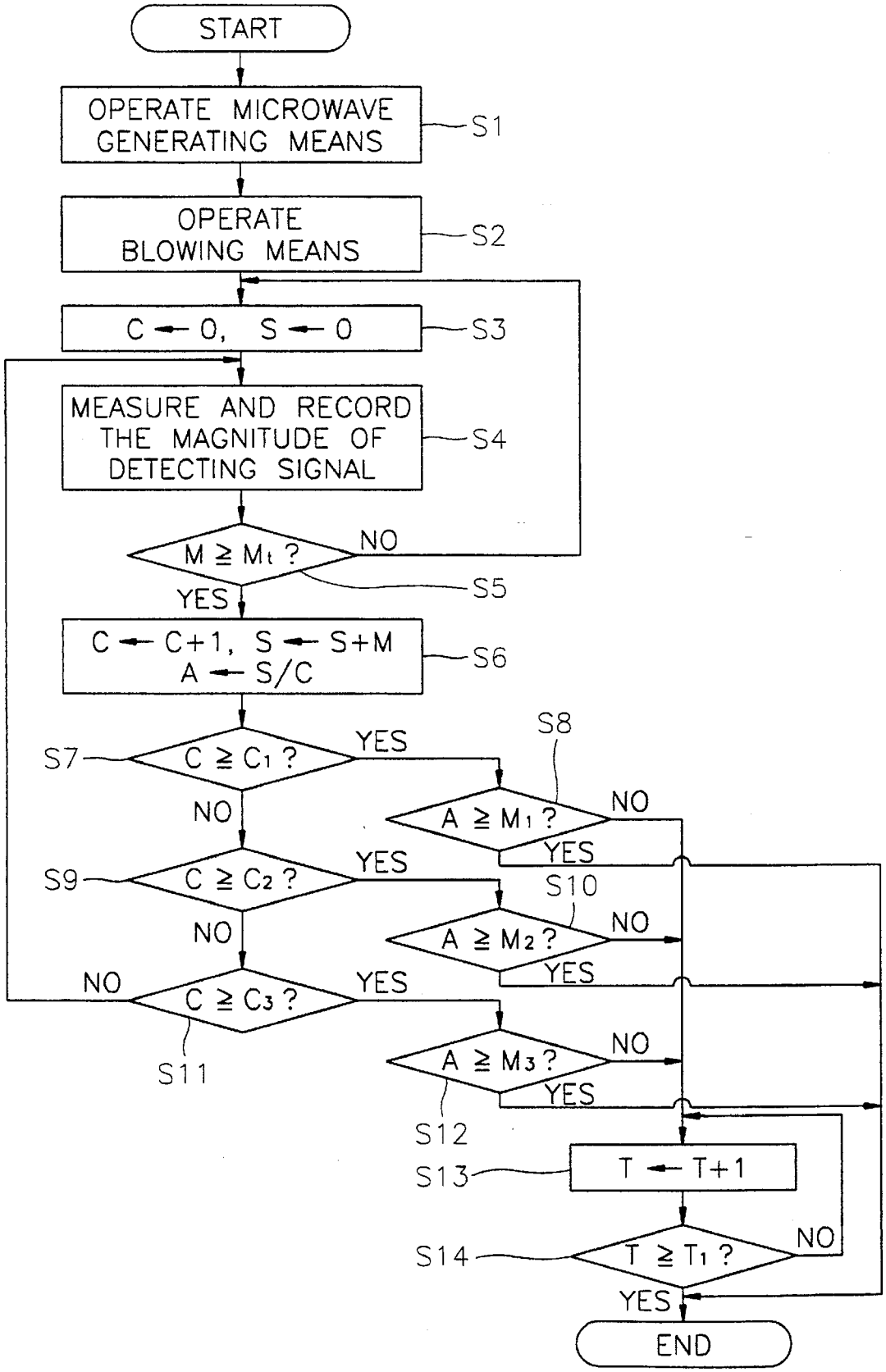
FIG. 2 is a flow chart for illustrating a method for cooking by using a vapor sensor in the microwave oven shown in FIG. 1.

FIG. 2 is a flow chart for illustrating a method for cooking by using a vapor sensor in the microwave oven shown in FIG. 1. As shown in FIG. 2, when the food is to be cooked by using microwave oven 10 having the structure as above, if a user presses a start key (not shown) to be 'ON' in order to start the automatic cooking operation, a control section (not shown) senses the 'ON' state of the start key to supply a control signal to a load driving section (not shown). When the control signal is provided to high voltage transformer 100 included in the load driving section, high voltage transformer 100 supplies the high voltage to a microwave generating section such as magnetron 200 (step S1). At this time, magnetron 200 generates the microwave, and then the control section drives the blowing section such as fan motor 400 to start the blow operation (step S2). Accordingly, by the blowing operation of fan motor 400, the microwave energy supplied by magnetron 200 is transmitted to and diffused throughout the internal portion of the cooking chamber via first blow holes 311 formed in the upper portion of first sidewall which is included in cavity 300, thereby heating the food.

Figure 3:
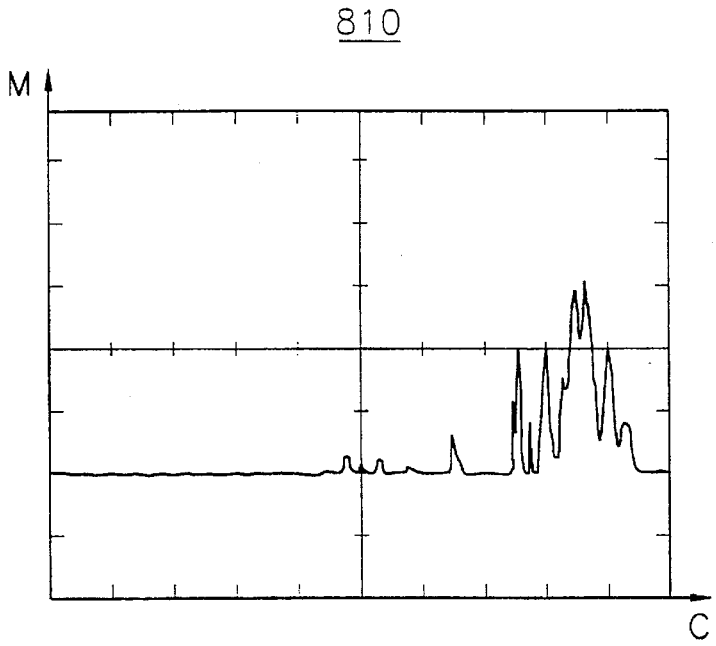
FIGS. 3 and 4 are waveform diagrams for respectively illustrating waveforms of the detecting signals supplied from the vapor sensor shown in FIG. 1.
Figure 4:
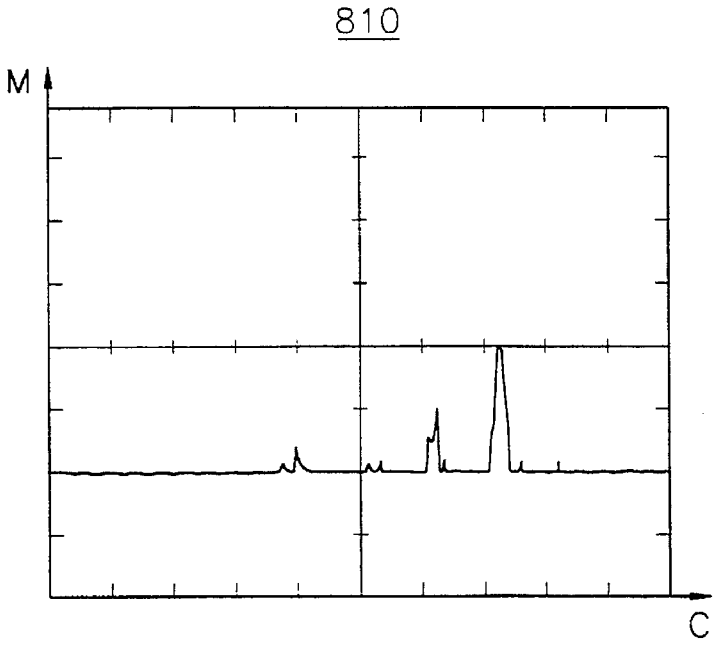

FIGS. 3 and 4 are waveform diagrams for respectively illustrating waveforms of the detecting signals supplied from the vapor sensor shown in FIG. 1. As described above, the control section drives fan motor 400 (step S2), and initializes to 'zeros' both a variable C of a counter (not shown) corresponding to a phase of a detecting signal 810 and a sum variable S defined as the following equation 1 in order to measure an output of vapor sensor 800 (i.e., a magnitude M of detecting signal 810 supplied from vapor sensor 800) responsive to the driving of fan motor 400 (step S3).

$$S-S+M \qquad \text{equation 1}$$

The water vapor of the food subjected to heating, generated by the microwave energy which is diffused throughout cavity 300, is discharged along the air flow which effuse from first blow holes 311 formed in the upper portion of a first sidewall 310 of cavity 300 by the blowing operation of a fan motor 400 and sequentially passes through first exhaust holes 321 formed in the lower portion of a second sidewall 320 disposed in opposition to first sidewall 310 and first discharge holes 500. Also, the water vapor is discharged along the air flow which sequentially passes through second exhaust holes 331 formed in the central portion of a ceiling portion 330 of cavity 300, a wind path 500 and second discharge holes 700.

At this time, the energy of the water vapor discharged along wind path 600 is sensed by vapor sensor 800 installed in an inlet of second discharge holes 700, and the control section measures to record magnitude M of detecting signal 810 supplied from vapor sensor 800 (step S4). The control section judges whether magnitude M of detecting signal 810 is greater than or equal to a magnitude $M_1$ of a reference detecting signal (step S5). If magnitude M of detecting signal 810 is greater than or equal to magnitude $M_1$ of the reference detecting signal, the control section determines that a temperature of the food subjected to heating is higher than a first predetermined temperature on the basis of magnitude M of detecting signal 810. Thus, in step S6, the control section calculates values of both the variable C of the counter and the sum variable S, and also calculates, on the basis of the calculated values of both variable C of the counter and sum variable S, a value of an average magnitude A which is an average value of magnitudes M of detecting signals 810 In terms of the following equation 2 when it is judged that the measured magnitude M of detecting signal 810 supplied from vapor sensor 800 is greater than or equal to magnitude $M_1$ of the reference detecting signal.

C–C+1

S–S+M

A–S / C, equation 2 where magnitude M of detecting signal 810 supplied from vapor sensor 800 is proportional to the temperature of molecules of the water vapor and the number of the molecules of the water vapor generated from the food subjected to heating. The above two factors also affect phase C (a value indicated by variable C of a counter) of detecting signal 810. Namely, magnitude M of detecting signal 810 is affected by the temperature of the molecules of the water vapor and the number of the molecules of the water vapor, and phase C of detecting signal 810 is affected by the number of the molecules of the water vapor. Therefore, when the control section sets a first, second and third reference magnitudes $M_1$, $M_2$ and $M_3$. Then, phase C of detecting signal 810 corresponds to the value of the counter, and first, second and third phases $C_1$, $C_2$ and $C_3$ have a relation that $0<C_3<C_2<C_1$.

If it is determined that average magnitudes A of detecting signals 810 respectively calculated with respect to detecting signals 810 which range over first, second and third phase coordinates $C_1$, $C_2$ and $C_3$ from a reference point in the same axis which designates the phase coordinates, are greater than or equal to first, second and third reference magnitudes $M_1$, $M_2$ and $M_3$, the control section determines that the size of the container filled with the food subjected to heating is proper. Therefore, the control section doesn't execute an additional heating operation and stops the automatic cooking operation. That is, the waveform of detecting signal 810 shown in FIG. 3 is a waveform recorded by the control section when the container has the proper size.

The above operation will be described as follows with reference to FIG. 2 in accordance with the steps. In step S5, the control section judges whether the measured magnitude M of detecting signal 810 supplied from vapor sensor 800 is greater than or equal to magnitude $M_1$ of the reference detecting signal. If the measured magnitude M of detecting signal 810 supplied from vapor sensor 800 is smaller than magnitude $M_1$ of the reference detecting signal, the control section returns to step S3 to repeatedly perform the succeeding steps. If measured magnitude M of detecting signal 810 supplied from vapor sensor 800 is greater than or equal to magnitude $M_1$ of the reference detecting signal, the control section calculates in step S6 the value of the variable of the counter, the value of the sum variable, and the value of average magnitude A of detecting signals 810. Next, the control means judges in step S7 whether the value of variable C of the counter representing the phase of detecting signal 810 is greater than or equal to first phase $C_1$.

When the value of variable C of the counter is greater than or equal to first phase $C_1$, the second control section judges in step S8 whether the value of average magnitude A of detecting signals 810 is greater than or equal to first reference magnitude $M_1$ corresponding to a first reference temperature of the food subjected to heating. If the value of variable C of the counter is smaller than first phase $C_1$, the control section judges in step S9 whether the value of variable C of the counter is greater than or equal to second phase $C_2$.

When the value of variable C of the counter is greater than or equal to second phase $C_2$, the control section judges in step S10 whether the value of average magnitude A is greater than or equal to second reference magnitude $M_2$ corresponding to a second reference temperature of the food subjected to heating. If the value of variable C of the counter is smaller than second phase $C_2$, the control section judges in step S11 whether the value of variable C of the counter is greater than or equal to third phase $C_3$. If the value of variable C of the counter is smaller than third phase $C_3$, the control section returns to step S4 to repeatedly perform the succeeding steps. If the value of variable C of the counter is greater than or equal to third phase $C_3$, the control section judges in step 12 whether the value of average magnitude A is greater than or equal to third references magnitude $M_3$ corresponding to a third reference temperature of the food subjected to heating.

As shown in FIG. 2, if the values of average magnitudes A of detecting signals 810 is smaller than first, second, or third reference magnitudes $M_1$, $M_2$, or $M_3$ in step S8, S10, or S12, the control section determines that the temperature of the water vapor molecules is low although there are lots of the water vapor molecules. IN other words, since the control means determines that the size of the container filled with the food subjected to heating is large, the heating operation is carried out for a heating time T (step S13). Thereafter, in step S14, in order to raise the temperature of the food subjected to heating to the second predetermined temperature, the control section judges whether heating time T is greater than or equal to an additional time $T_1$ which is preset by an experiment. If heating time T is smaller than additional time $T_1$, the control section returns to step S13 so repeatedly perform the additional heating operation. If the temperature of the food subjected to heating is raised to the desired reasonable temperature, the control section stops the additional heating operation.

Namely, when the same amount of foods are respectively served in two containers having different sizes and heated, as shown in FIG. 4, the water vapor is first generated from the larger container. However, since the temperature of the first generated water vapor is relatively low, the control means performs the additional heating operation for the preset time, thereby obtaining me result of cooking which the user wants to get.

In the method for controlling the cooking by using a vapor sensor in a microwave oven according to the present invention, while the food is cooked by means of the microwave oven equipped with the vapor sensor therein, the output of the vapor sensor varied in accordance with the sizes of containers filled with food subjected to heating is selectively controlled, and the malfunction of the vapor sensor caused by the different sizes of containers can be prevented.

Therefore, the performance and life span of the microwave oven are significantly enhanced to remarkably heighten the user's reliability concerning the performance of the microwave oven and the consumer's intention with which the microwave oven is purchased.

While the present invention has been particularly shown and described with reference to the particular embodiment thereof, it will be understood by those skilled in the art that various changes in form and details may be effected therein without departing from the spirit and scope of the invention as defined by the appended claims.

What is claimed is:

1. A method for controlling cooking by using a vapor sensor in a microwave oven, said method comprising the steps of:

measuring a magnitude of a detecting signal produced from said vapor sensor and varied in accordance with the sizes of containers filled with food subjected to heating in response to an energy of water vapor of the food which is generated from the food while the food is cooked by using said microwave oven equipped with said vapor sensor therein;

determining whether or not a temperature of the food is a second predetermined temperature by comparing values of variables of a counter with reference phases and by comparing average magnitudes with magnitudes of the reference detecting signals when it is judged that the temperature of the food exceeds a first predetermined temperature based on the measured magnitude of the detecting signal of said vapor sensor; and additionally heating the food for a preset time until the temperature of the food is raised to the second predetermined temperature when it is determined that the temperature is lower than the second predetermined temperature.

2. The method for controlling cooking by using a vapor sensor in a microwave oven as claimed in claim 1, wherein said measuring step comprises the substeps of:

operating microwave generating means by load driving means, and operating blowing means by control means;

initializing both a variable of a counter and a sum variable to zeros in order to measure the magnitude of the detecting signal supplied from said vapor senor; and measuring the magnitude of the detecting signal supplied from said vapor sensor in response to the suction or discharge of heat of the water vapor generated from the food in accordance with the driving of said blowing means.

3. The method for controlling cooking by using a vapor sensor in a microwave oven as claimed in claim 1, wherein said determining step comprises the substeps of:

judging whether the measured magnitude of the detecting signal from said vapor sensor is greater than or equal to the magnitude of a reference detecting signal;

returning to the step of initializing both the variable or said counter and the sum variable to zeros and repeating the succeeding steps when it is judged that the measured magnitude of the detecting signal supplied from said vapor sensor is smaller than the magnitude of the reference detecting signal;

calculating values of both the variable or said counter and the sum variable, and calculating, based on the calculated values of both the variable of said counter and the sum variable, a value of an average magnitude which is an average value of the magnitudes of the detecting signals when it is judged that the measured magnitude of the detecting signal supplied from said vapor sensor is greater than or equal to the magnitude of the reference detecting signal;

judging whether the value of the variable of said counter representing a phase of said detecting signal is greater than or equal to a first phase;

judging whether the value of the average magnitude of the detecting signals is greater than or equal to a first reference magnitude corresponding to a first reference temperature of the food subjected to heating when it is judged that the value of the variable of said counter is greater than or equal to the first phase;

judging whether the value of the variable of said counter is greater than or equal to a second phase when it is judged that the value of the variable of said counter is smaller than the first phase;

judging whether the value of the average magnitude is greater than or equal to the second reference magnitude corresponding to a second reference temperature of the food subjected to heating when it is judged that the value of the variable of said counter is greater than or equal to the second phase;

judging whether the value of the variable of said counter is greater than or equal to a third phase when it is judged that the value of the variable of said counter is smaller than the second phase;

judging whether the value of the average magnitude is greater than or equal to a third reference magnitude corresponding to the third reference temperature of the food subjected to heating when it is judged that the value of the variable of said counter is greater than or equal to the third phase;

returning to the step of measuring the magnitude of the detecting signal supplied from said vapor sensor and repeating the succeeding steps when it is judged that the value of the variable of said counter is smaller than the third phase; and stopping an automatic cooking operation without executing an additional heating operation when the value of the average magnitude of the detecting signals is greater than or equal to the first, second, or third reference magnitude to judge that the size of the container is appropriate.

4. The method for controlling cooking by using a vapor sensor in a microwave oven as claimed in claim 3, wherein said variable of said counter is the phase of the detecting signal supplied from said vapor sensor, and the variable of said counter is designated by a relation that C–C+1, where said variable of said counter is denoted by C.

5. The method for controlling cooking by using a vapor sensor in a microwave oven as claimed in claim 3, wherein said sum variable is designated by a relation that S–S+M, where said sum variable and the magnitude of the detecting signal are respectively denoted by S and M.

6. The method for controlling cooking by using a vapor sensor in a microwave oven as claimed in claim 3, wherein said average magnitude is designated by a relation that A–S/C, where said average magnitude is denoted by A, and the sum variable and the phase are respectively denoted S and C.

7. The method for controlling cooking by using a vapor sensor in a microwave oven as claimed in claim 3, wherein said first, second and third phases have a relation that $0<C_3<C_2<C_1$, where said first, second and third phases are respectively denoted by $C_1$, $C_2$ and $C_3$.

8. The method for controlling cooking by using a vapor sensor in a microwave oven as claimed in claim 3, wherein said first, second and third reference magnitudes are relevant magnitude coordinate values when phase coordinate values are respectively the first, second and third phases.

9. The method for controlling cooking by using a vapor sensor in a microwave oven as claimed in claim 1, wherein said additionally heating step comprises the substeps of:

executing the additional heating operation for the additional time preset in order to raise the temperature of the food subjected to heating to the second predetermined temperature when the average magnitude is smaller than the first, second, or third reference magnitudes to judge that the average temperature of the molecules of the water vapor generated from the food is lower than the second predetermined temperature;

judging whether the heating time is greater than or equal to the additional time;

returning to the step of executing the additional heating operation and repeating the additional heating operation when the heating time is smaller than the additional time; and stopping the additional heating operation when the heating time is greater than or equal to the additional time.

10. A method for controlling cooking by using a vapor sensor in a microwave oven, said method comprising the steps of:

operating microwave generating means by load driving means, and operating blowing means by control means;

initializing both a variable of a counter and a sum variable to zeros in order to measure the magnitude of the detecting signal supplied from said vapor sensor;

measuring the magnitude of the detecting signal supplied from said vapor sensor in response to the suction or discharge of heat of the water vapor generated from the food in accordance with the driving of said blowing means;

judging whether the measured magnitude of the detecting signal from said vapor sensor is greater than or equal to the magnitude of a reference detecting signal;

returning to the step of initializing both the variable of said counter and the sum variable to zeros and repeating the succeeding steps when it is judged that the measured magnitude of the detecting signal supplied from said vapor sensor is smaller than the magnitude of the reference detecting signal;

calculating values of both the variable of said counter and the sum variable, and calculating, based on the calculated values of both the variable of said counter and the sum variable, a value of an average magnitude which is an average value of the magnitudes of the detecting signals when it is judged that the measured magnitude of the detecting signal supplied from said vapor sensor is greater than or equal to the magnitude of the reference detecting signal;

judging whether the value of the variable of said counter representing a phase of said detecting signal is greater than or equal to a first phase;

judging whether the value of the average magnitude of the detecting signals is greater than or equal to a first reference magnitude corresponding to a first reference temperature of the food subjected to heating when it is judged that the value of the variable of said counter is greater than or equal to the first phase;

judging whether the value of the variable of said counter is greater than or equal to a second phase when it is judged that the value of the variable of said counter is smaller than the first phase;

judging whether the value of the average magnitude is greater than or equal to the second reference magnitude corresponding to a second reference temperature of the food subjected to heating when it is judged that the value of the variable of said counter is greater than or equal to the second phase;

judging whether the value of the variable of said counter is greater than or equal to a third phase, when it is judged that the value of the variable of said counter is smaller than the second phase;

judging whether the value of the average magnitude is greater than or equal to a third reference magnitude corresponding to the third reference temperature of the food subjected to heating when it is judged that the value of the variable of said counter is greater than or equal to the third phase;

returning to the step of measuring the magnitude of the detecting signal supplied from said vapor sensor and repeating the succeeding steps when it is judged that the value of the variable of said counter is smaller than the third phase;

stopping an automatic cooking operation without executing an additional heating operation when the value of the average magnitude of the detecting signals is greater than or equal to the first, second, or third reference magnitude to judge that the size of the container is appropriate;

executing the additional heating operation for the additional time preset in order to raise the temperature of the food subjected to heating to the second predetermined temperature when the average magnitude is smaller than the first, second, or third reference magnitudes to judge that the average temperature of the molecules of the water vapor generated from the food is lower than the second predetermined temperature;

judging whether the heating time is greater than or equal to the additional time;

returning to the step of executing the additional heating operation and repeating additional heating operation when the heating time is smaller than the additional time; and stopping the additional heating operation when the heating time is greater than or equal to the additional time.

11. The method for controlling cooking by using a vapor sensor in a microwave oven as claimed in claim 10, wherein said first, second and third reference magnitudes are relevant magnitude coordinate values when phase coordinate values are respectively the first, second and third phases.

12. The method for controlling cooking by using a vapor sensor in a microwave oven as claimed in claim 10, wherein said variable of said counter is the phase of the detecting signal supplied from said vapor sensor, and the variable of said counter is designated by a relation that C–C+1, where said variable of said counter is denoted by C.

13. The method for controlling cooking by using a vapor sensor in a microwave oven as claimed in claim 10, wherein said sum variable is designated by a relation that S–S+M, where said sum variable and the magnitude of the detecting signal are respectively denoted by S and M.

14. The method for controlling cooking by using a vapor sensor in a microwave oven as claimed in claim 10, wherein said average magnitude is designated by a relation that A–S/C, where said average magnitude is denoted by A, and the sum variable and the phase are respectively denoted S and C.

15. The method for controlling cooking by using vapor sensor in a microwave oven as claimed in claim 10, wherein said first, second and third phases have a relation that $0<C_3<C_2<C_1$, where said first, second and third phases are respectively denoted by $C_1$, $C_2$ and $C_3$.

* * * * *